US005522946A

United States Patent [19]

Tomita et al.

[11] Patent Number: 5,522,946

[45] Date of Patent: Jun. 4, 1996

[54] AMORPHOUS MAGNETIC THIN FILM AND PLANE MAGNETIC ELEMENT USING SAME

[75] Inventors: Hiroshi Tomita; Tetsuo Inoue; Hiromi Fuke; Toshiro Sato; Tetsuhiko Mizoguchi, all of Kanagawa, Japan

[73] Assignee: Kabushiki Kaisha Toshiba, Kanagawa-ken, Japan

[21] Appl. No.: 266,757

[22] Filed: Jun. 28, 1994

[30] Foreign Application Priority Data

Jun. 29, 1993 [JP] Japan ..... 5-184366
Feb. 14, 1994 [JP] Japan ..... 6-039167

[51] Int. Cl.[6] ..... H01F 1/153

[52] U.S. Cl. ..... 148/304; 148/306; 148/313; 148/315; 420/121

[58] Field of Search ..... 148/304, 403, 148/306, 313, 315; 420/121

[56] References Cited

U.S. PATENT DOCUMENTS 4,921,763 5/1990 Karamon ..... 148/304

FOREIGN PATENT DOCUMENTS 63-119209 5/1988 Japan .
2198146 6/1988 United Kingdom ..... 148/304

OTHER PUBLICATIONS

"A New Type of High–Resistive Soft Magnetic Amorphous Films Utilized For A Very High–Frequency Range," H. Karamon, Journal Of Applied Physics, vol. 63, pp. 4306, 1988 (Apr. 15, 1988).

*Primary Examiner*—John Sheehan
*Attorney, Agent, or Firm*—Finnegan, Henderson, Farabow, Garrett & Dunner

[57] ABSTRACT

An amorphous magnetic thin film possesses as at least part of a thin film forming area a microstructure composed of a first amorphous phase containing at least either of iron and cobalt and bearing magnetism and a second amorphous phase disposed round the first amorphous phase and containing boron and at least one element selected from among the elements of the 4B Group in the Periodic Table of Elements and exhibits uniaxial magnetic anisotropy in the plane of film. The amorphous magnetic thin film possesses soft magnetism concurrently satisfying high saturation magnetization and high resistivity and, at the same time, easily acquires high frequency permeability by applying magnetic field in the hard axis of magnetization. Use of these amorphous magnetic thin films for plane magnetic elements permits the plane magnetic elements to be miniaturized and to be endowed with exalted performance. The amorphous magnetic thin film possesses a composition substantially represented by the formula:

$$(Fe_{1-x}Co_x)_{1-y}(B_{1-z}X_z)_y$$

(wherein X stands for at least one element selected from among the 4B Group elements and x, y, and z stand for numerals satisfying the expressions, $0<x0.5$, $0.06<y<0.5$, and $0<z<1$).

21 Claims, 12 Drawing Sheets

AMORPHOUS MAGNETIC THIN FILM AND PLANE MAGNETIC ELEMENT USING SAME

BACKGROUND OF THE INVENTION

1. Field of the Invention

This invention relates to an amorphous magnetic thin film for use in such plane magnetic elements as plane inductors and plane transformers and plane magnetic elements using the amorphous magnetic thin film.

2. Description of the Related Art

In recent years, the miniaturization of various electronic devices has been advancing at a lively space. In the meanwhile, the miniaturization of power source parts of the electronic devices has been proceeding slowly as compared with that of the electronic devices. As a result, the ratios of the volumes occupied by the power source parts to the whole volumes of the electronic devices are incessantly growing. The miniaturization of electronic devices hinges heavily on the realization of LSI with various circuits. Such miniaturization or integration, however, has been advancing slowly on such magnetic parts as inductors and transformers which are essential for the power source parts. This delay forms the main cause for the growth of the volumetric ratios of the power source parts.

For the solution of this problem, plane magnetic elements which severally combine a plane coil with a magnetic thin film have been proposed. Studies are being made in search of a method which is capable of imparting exalted performance to these plane magnetic elements. The magnetic thin film to be used in these plane magnetic elements is required to suffer only low loss and enjoy high saturation magnetization in a high frequency range of 1 MHz or more. It is suspected that the compatibility of low loss and high saturation magnetization at a high frequency will gain all the more in importance as the working frequencies of magnetic elements shift to the range of 10 MHz to 100 MHz in the future. For example, in the high frequency applying magnetic field, since the eddy current loss is conspicuous, alleviation of this loss necessitates lamination of magnetic films or impartation of exalted resistivity to individual magnetic films. High saturation magnetization forms an indispensable requirement for the purpose of increasing inductance density or energy density.

Even in the case of thin-film magnetic heads other than plane magnetic elements, it is only natural that magnetic thin films which concurrently enjoy low loss and high saturation magnetization in a high frequency range should effectively manifest their functions in proportion as the recording density increases, the recording media tend toward higher coercive force and higher energy product, and the operating frequency augments. These requirements are imposed as well on other magnetic elements.

Incidentally in the high frequency range, the permeability is mainly procured in the magnetization reversal of rotation. As a result, the applying magnetic field in the direction of the hard axis of magnetization gains in importance and the high frequency permeability and the high frequency loss in the direction of the hard axis of magnetization constitute themselves important physical properties. The high frequency permeability is associated with various physical properties, sapecially, magnetic anisotropy field. The high frequency permeability varies generally in proportion to the reciprocal of the magnetic anisotropy field. For the purpose of realizing high saturation magnetization, low loss, and high permeability in the high frequency range mentioned above, therefore, uniaxial anisotropy in the film planes and suitable uniaxial magnetic anisotropy energy are necessary for the soft magnetic thin films.

For the sake of satisfying the properties which magnetic thin films are required to possess as described above, such ordinary magnetic thin films as are made of a transition metal offer unduly low resistivity and necessitate a complicated structure such as lamination. This necessity entails complication of the process of production and addition to the cost of production. Such oxide type materials as soft ferrites which have high resistivity are deficient in saturation magnetization and unfit for the sake of miniaturizing devices and exalting the output.

For the purpose of overcoming these drawbacks of the conventional materials, efforts are being devoted now to the research and development of heteroamorphous films (refer, for example, to Laid-open Japanese Pattent Application SHO.63-119,209). The soft magnetic thin film which is disclosed in Laid-open Japanese Pattent Application SHO.63-119,209, however, is substantially isotropic magnetically, though it concurrently acquires high saturation magnetization and high resistivity. It does not fit the purpose of imparting and controlling the permeability which is optimized for the properties owned by a given magnetic element. Particularly, microminiaturized thin film inductance elements necessitate an inplane uniaxial magnetic anisotropy of a specific magnitude.

The plane magnetic elements intended for miniaturization, as described above, demand soft magnetic thin films which concurrently satisfy high saturation magnetization and low loss in the high frequency range. Further, for the purpose of imparting a desired high frequency permeability to plane magnetic elements, acquisition of the high frequency permeability by applying magnetic field in the hard axis of magnetization constitutes itself an important requirement. It becomes necessary, therefore, to impart inplane uniaxial magnetic anisotropy to the magnetic thin films and, at the same time, to heighten the controllability of this anisotropy. In the circumstances, the desirability of developing a soft magnetic thin film which easily acquires desired high frequency permeability by applying magnetic field in the hard axis of magnetization and, at the same time, satisfies high saturation magnetization and high resistivity by the impartation and control of the inplane uniaxial magnetic anisotropy has been finding enthusiastic recognition.

SUMMARY OF THE INVENTION

An object of this invention, therefore, is to provide an amorphous magnetic thin film for use in plane magnetic elements which enjoys compatibility between high saturation magnetization and high resistivity and, at the same time, facilitates acquisition of high frequency permeability by applying magnetic field in the hard axis of magnetization and further an amorphous magnetic thin film which possesses excellent high frequency permeability. Another object of this invention is to provide a plane magnetic element which permits miniaturization of devices and impartation of enhanced performance to devices.

An amorphous magnetic thin film of this invention for use in plane magnetic elements is characterized by possessing as at least part of a thin film forming area a microstructure composed of a first amorphous phase containing at least either of iron and cobalt and bearing magnetism and a second amorphous phase disposed round the first amorphous phase and containing boron and at least one element selected from among the Group 4B elements in the CAS version of the Periodic Table and exhibiting uniaxial magnetic anisotropy in the plane of film.

Another amorphous magnetic thin film of this invention is characterized by possessing of a composition substantially represented by the chemical formula (1):

$$(Fe_{1-x}Co_x)_{1-y}(B_{1-z}X_z)_y \quad (1)$$

(wherein X stands for at least one element selected from among such 4B Group elements as C, Si, and Ge and x, y, and z stand for numerals satisfying the expressions, $0<x\leqq 0.5$, $0.06<y<0.5$, and $0<z<1$) and possessing as at least part of a thin film forming area a microstructure composed of a first amorphous phase containing both iron and cobalt and bearing magnetism and a second amorphous phase disposed round the first amorphous phase and containing boron and at least one element selected from among Group 4B elements in the CAS version of the Periodic Table.

A plane magnetic element of this invention is characterized by being provided with a plane coil and an amorphous magnetic thin film disposed as superposed on at least one of the opposite surfaces of the plane coil, the amorphous magnetic thin film possessing as at least part of a thin film forming area a microstructure composed of a first amorphous phase containing at least either of iron and cobalt and bearing magnetism and a second amorphous phase disposed round the first amorphous phase and containing boron and at least one element selected from among the Group 4B elements in the CAS version Periodic Table and exhibiting uniaxial magnetic anisotropy in the plane of film.

The amorphous magnetic thin film of this invention for use in plane magnetic elements acquires high saturation magnetization and high resistivity owing to the microstructure which has a second amorphous phase containing boron and at least one element selected from among the elements of the 4B group disposed reticularly round a first amorphous phase containing at least either of iron and cobalt and bearing magnetism. The amorphous magnetic thin film easily acquires high frequency permeability by applying magnetic field in the hard axis of magnetization because it possesses uniaxial magnetic anisotropy in the plane of film. The amorphous magnetic thin film which possesses such soft magnetic properties as high saturation magnetization and high resistivity and acquires high frequency permeability by applying magnetic field in the hard axis of magnetization as described above contributes notably to miniaturization of plane magnetic elements and impartation of enhanced performance thereto. The plane magnetic element of this invention can be miniaturized and endowed with enhanced performance because it uses the amorphous magnetic thin film of the quality described above.

Incidentally, the amorphous magnetic thin film of this invention is capable of acquiring an amorphous diffraction peak when it is examined by the thin film X-ray diffraction method for determination of an X-ray diffraction peak. Specifically, it is rated as acceptable when a sample thereof as deposited, when tested by the thin film X-ray diffraction method using an angle of 1.0° for the incidence of X-ray, exhibits a first amorphous peak whose full width of half value is at least about 5.0°.

Figure 3A:
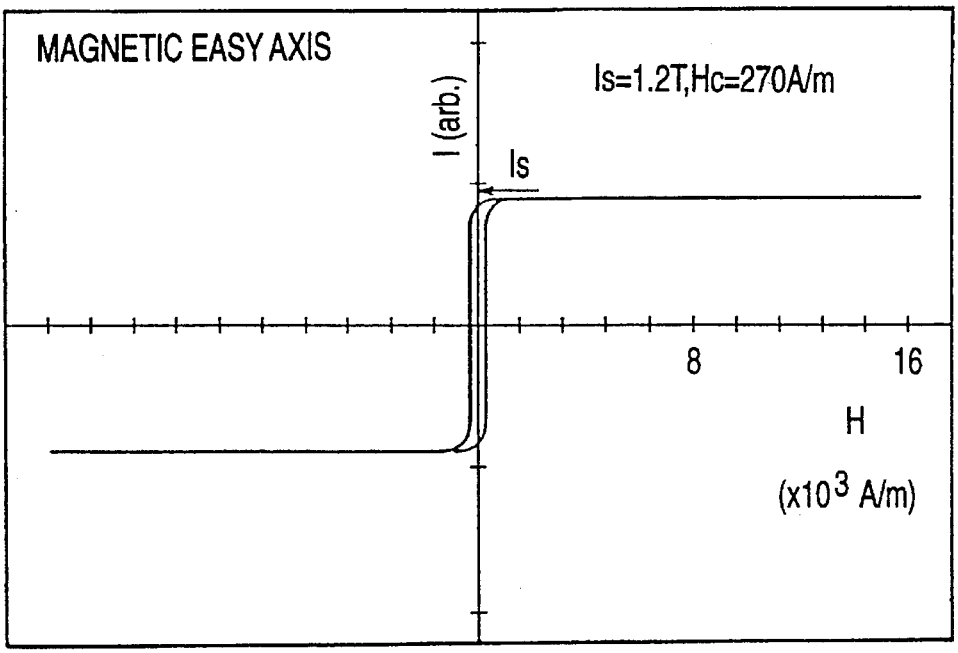
Figure 3B:
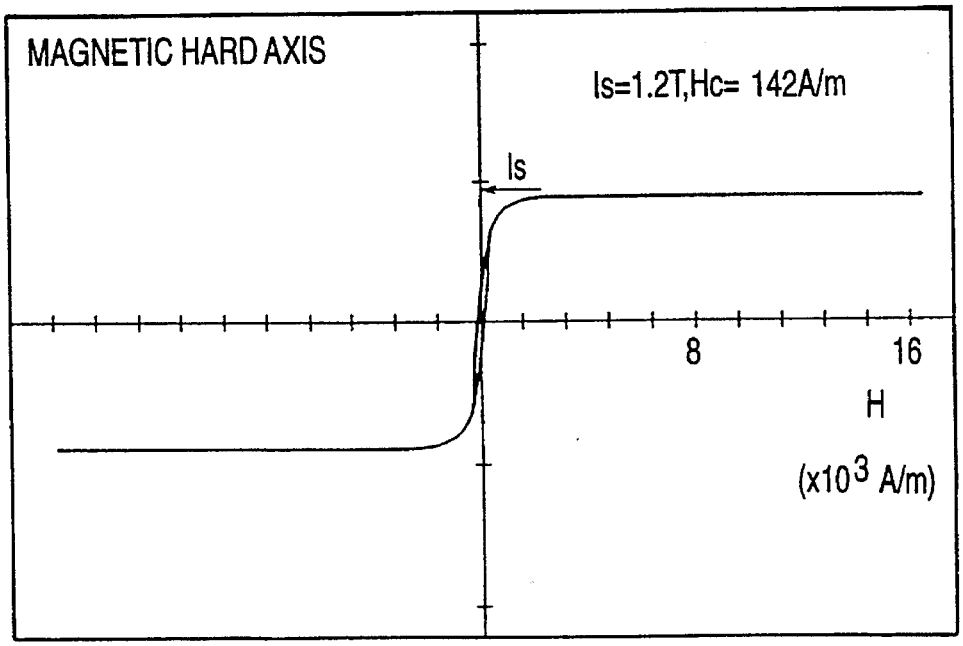

Each of FIGS. 3 and 3B is a diagram showing the magnetization curve of the double-phase amorphous magnetic thin film obtained in Example 1 of this invention.

Figure 4A:
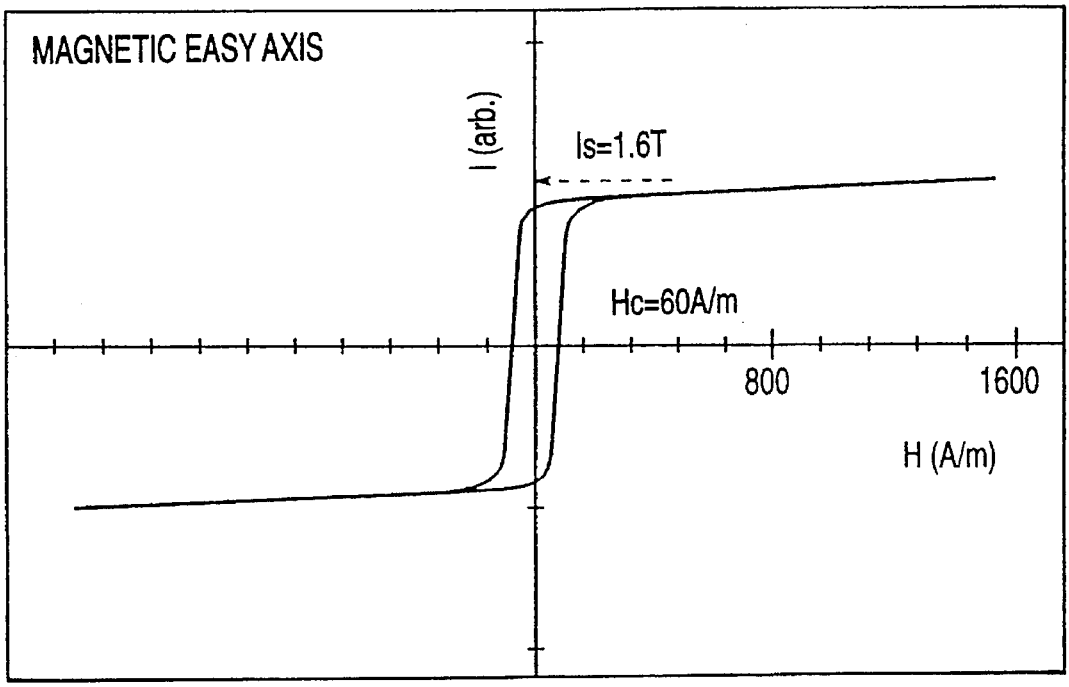
Figure 4B:
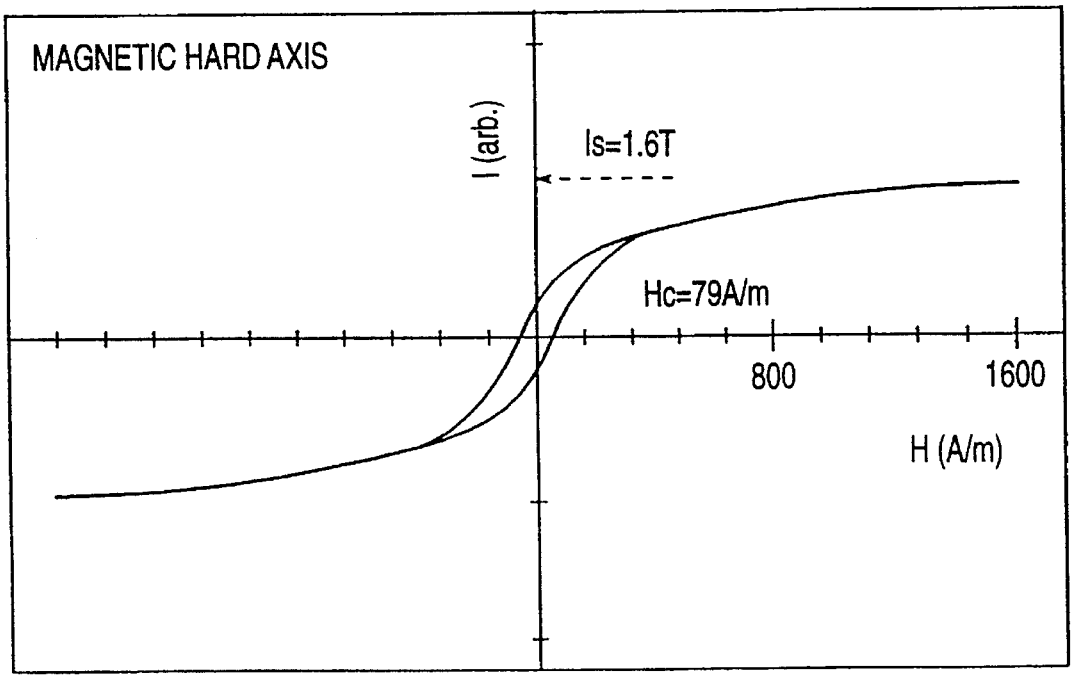

Each of FIGS. 4A and 4B is a diagram showing the magnetization curve of a double-phase amorphous magnetic thin film obtained in Example 5 of this invention.

Figure 5A:
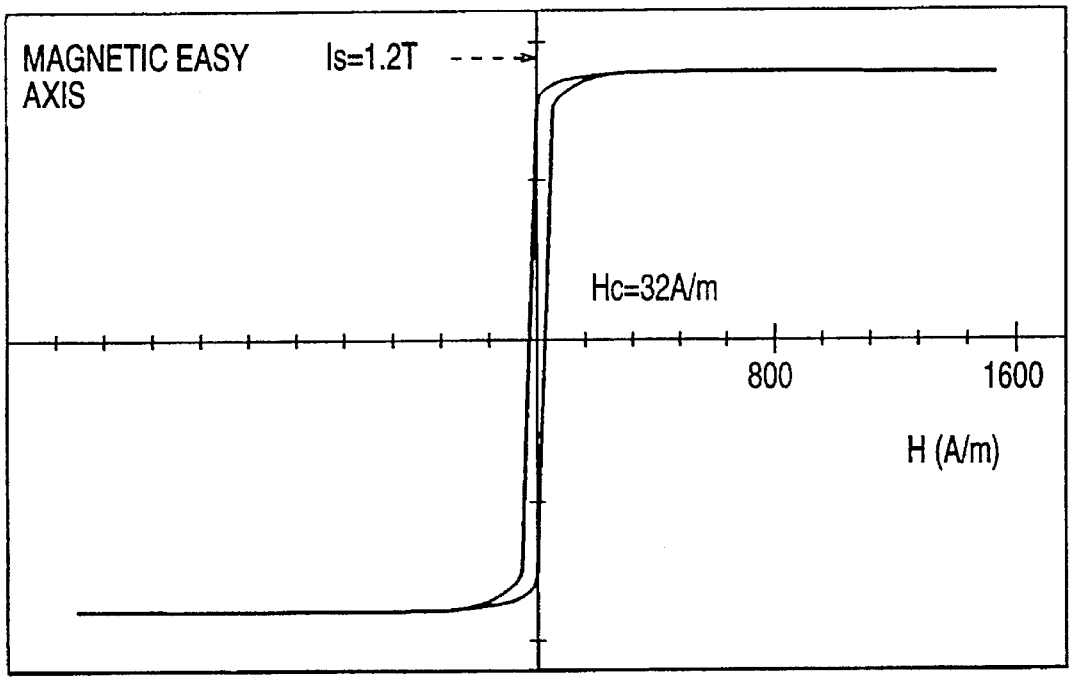
Figure 5B:
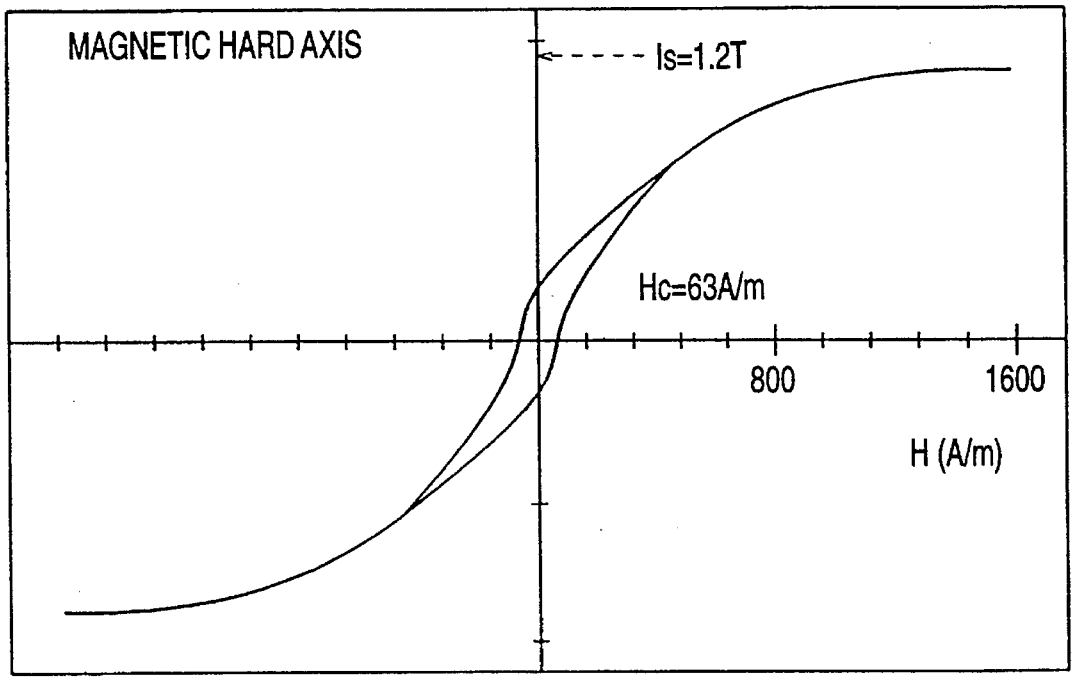

Each of FIGS. 5A and 5B is a diagram showing the magnetization curve of a double-phase amorphous magnetic thin film obtained in Example 6 of this invention.

Figure 6A:
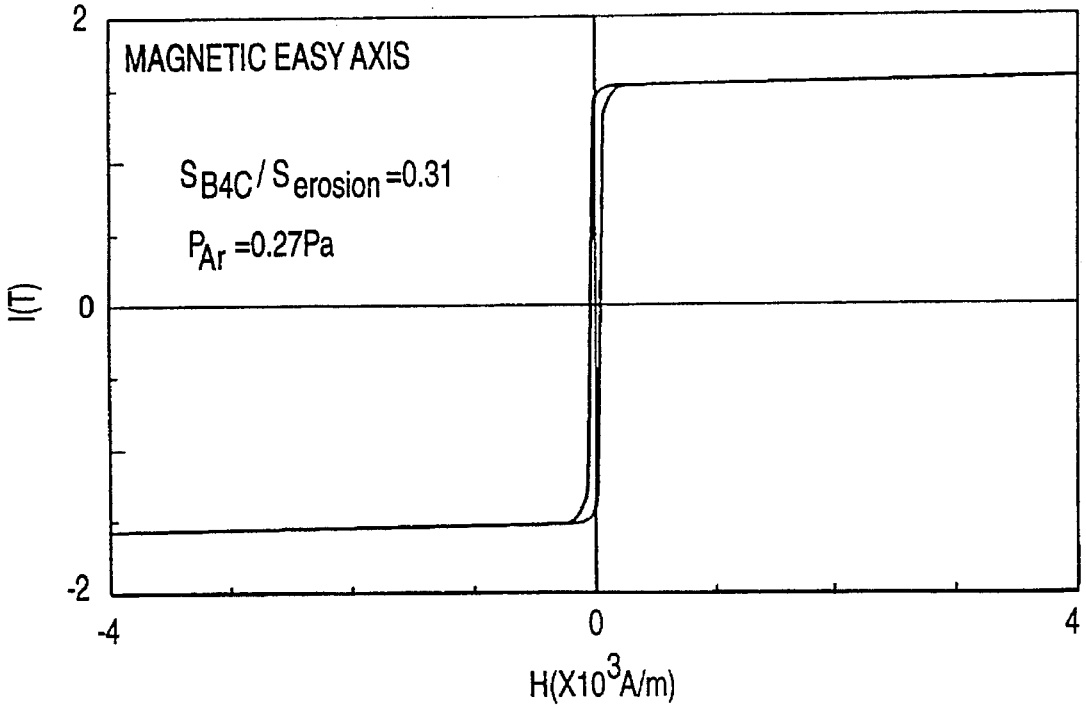
Figure 6B:
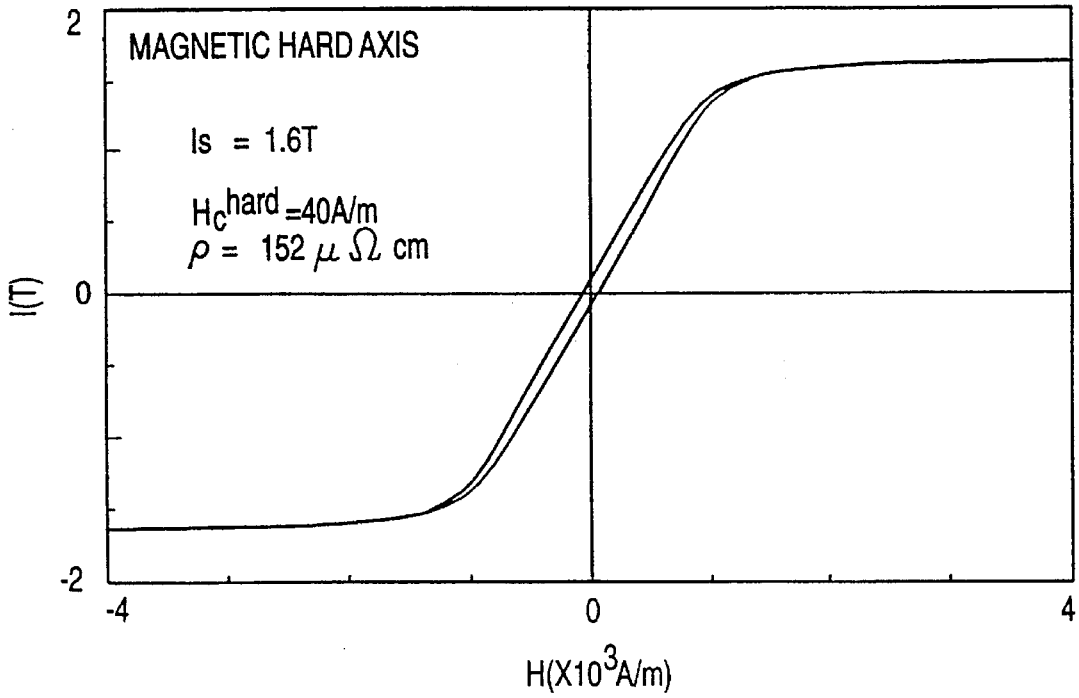
Figure 7A:
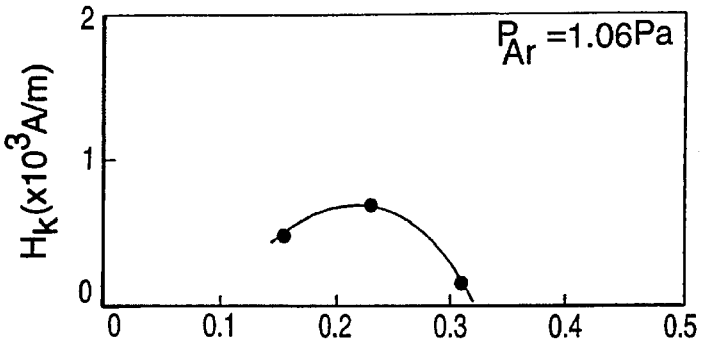
Figure 7B:
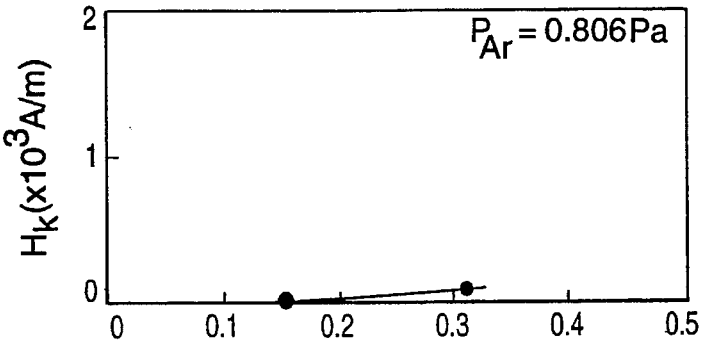
Figure 7C:
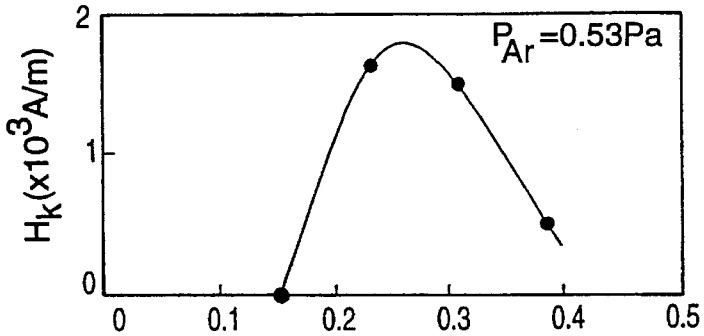
Figure 7D:
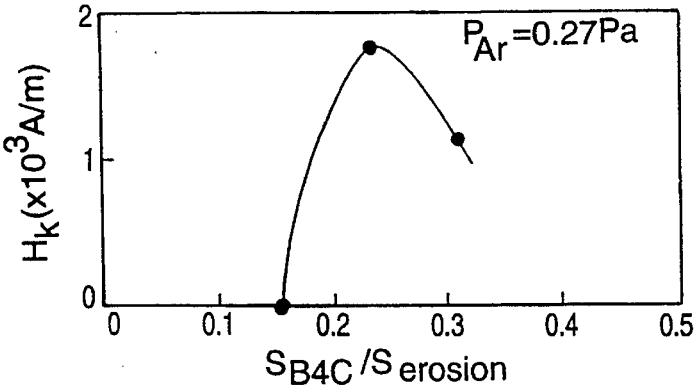

Each of FIGS. 6A and 6B is a diagram showing one example of magnetization curve of a double-phase amorphous magnetic thin film obtained in Example 8 of this invention.

Each of FIGS. 7A–7D is a diagram showing the anisotropic magnetic fields of various double-phase magnetic thin films obtained in Example 8 of this invention.

Figure 8:
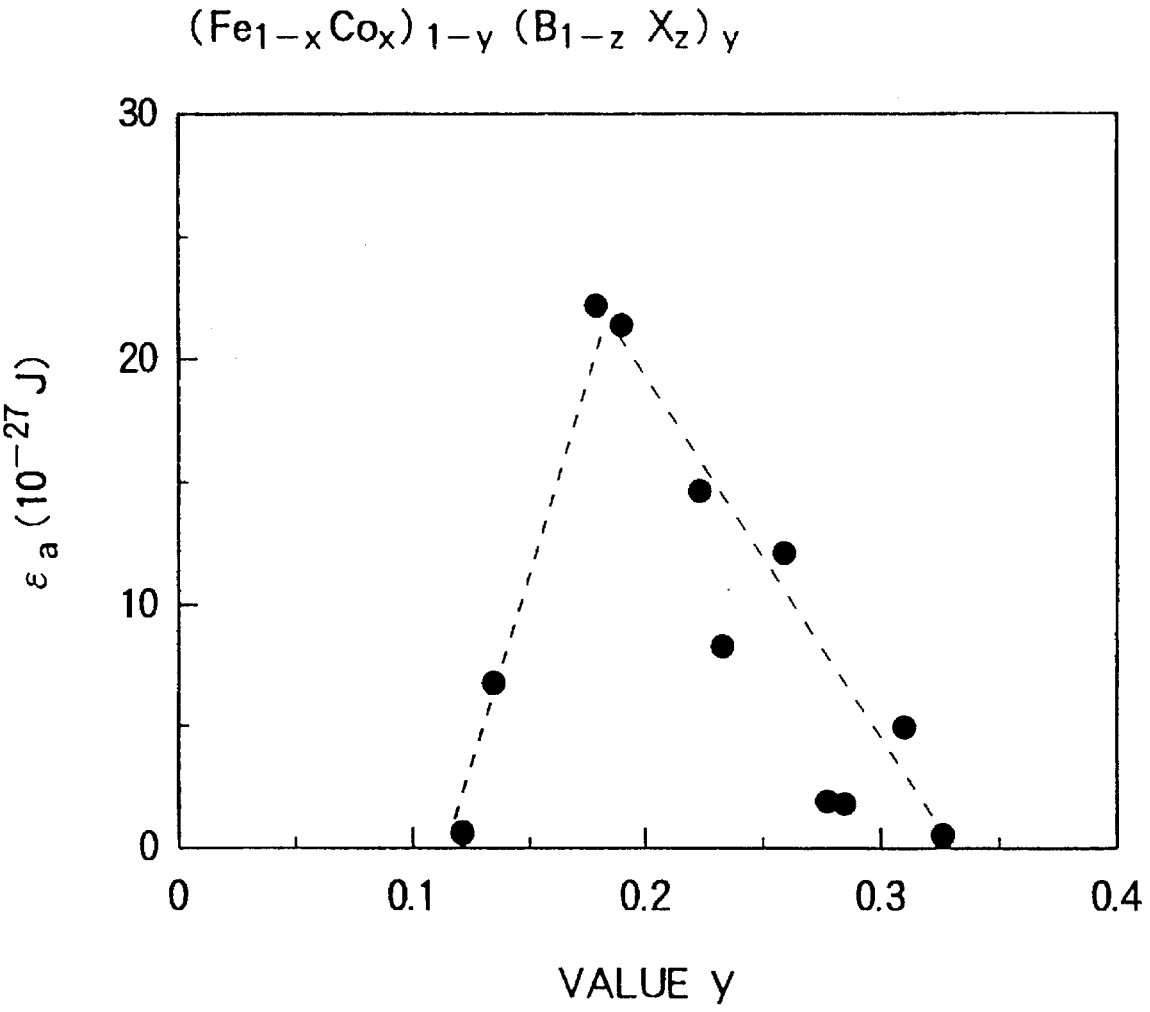

FIG. 8 is a diagram showing the dependency on composition ratio y of the magnetic anisotropic energy $\epsilon_a$ per atom of transition metal of the double-phase amorphous magnetic thin film obtained in Example 8 of this invention.

Figure 9A:
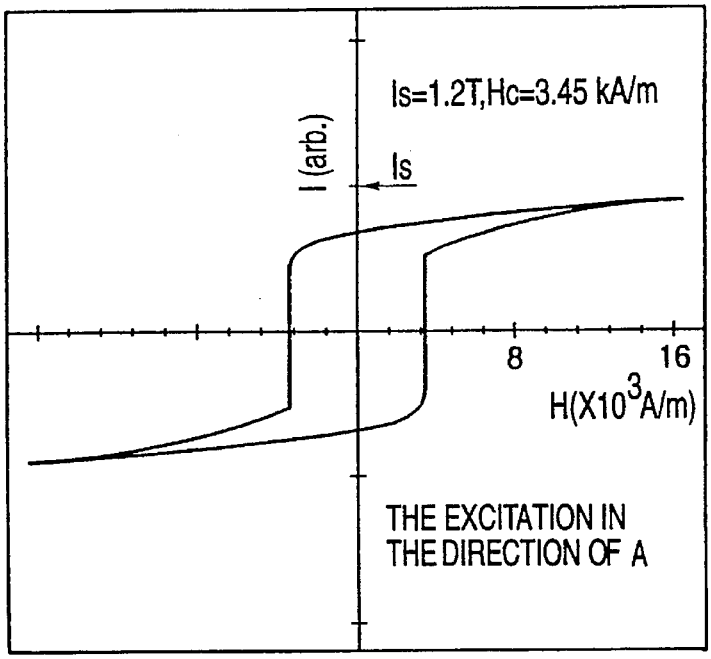
Figure 9B:
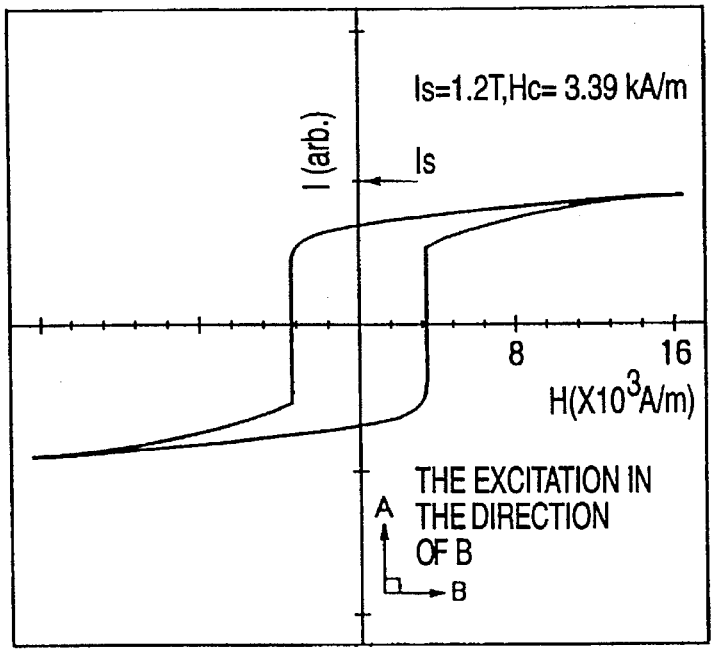

Each of FIGS. 9A and 9B is a diagram showing the magnetization curve of an amorphous magnetic thin film obtained in Comparative Experiment 2.

Figure 10A:
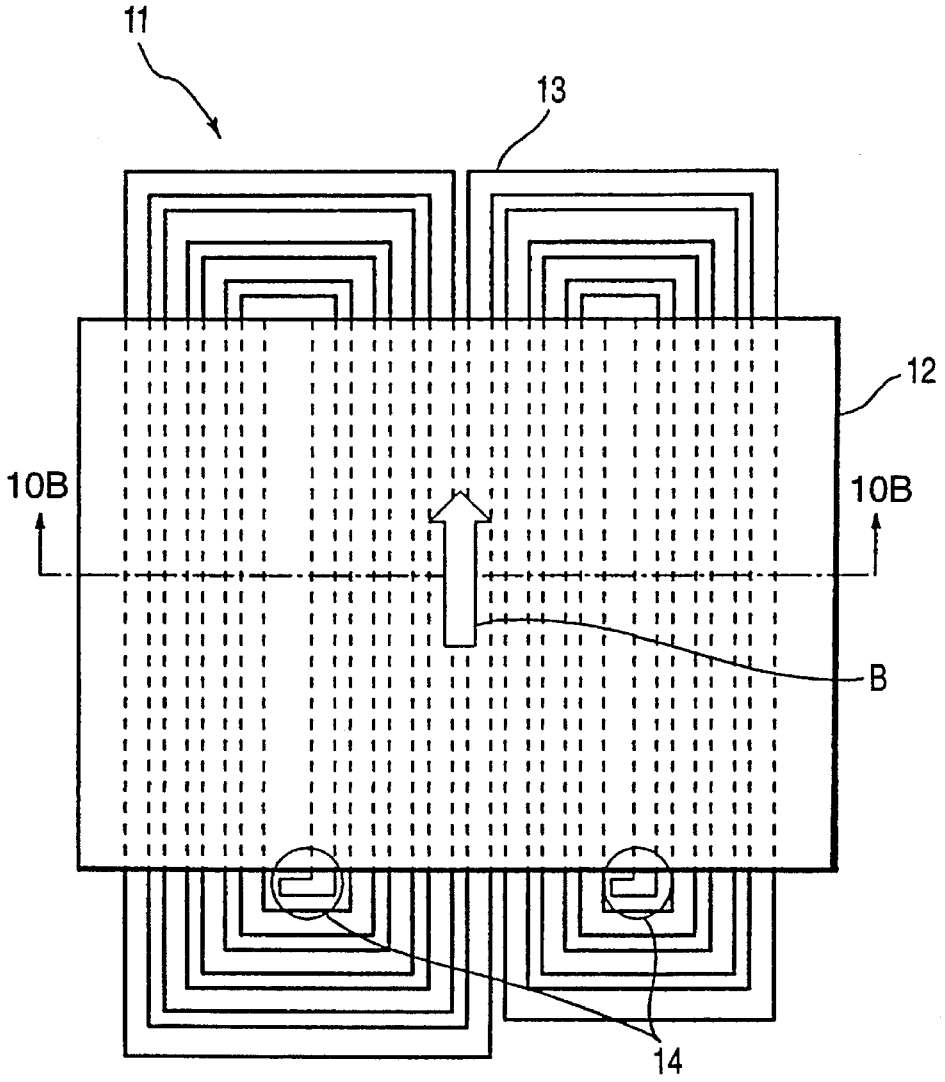

FIG. 10A is a diagram showing a plan view of a thin film inductor manufactured in Example 9 of this invention.

Figure 10B:
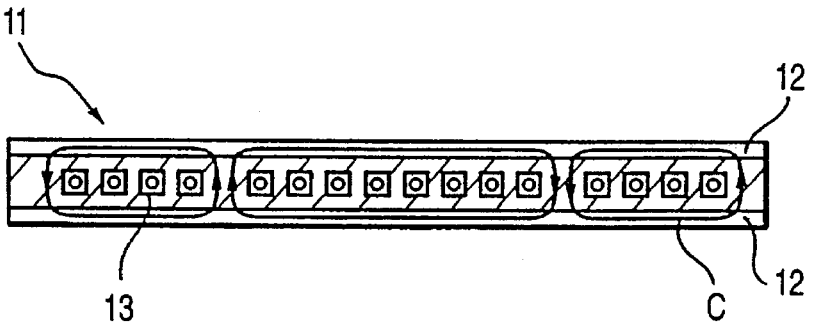

FIG. 10B is a diagram showing a cross section taken through the plan view diagram of FIG. 10A along the line 10B—10B.

Figure 11:
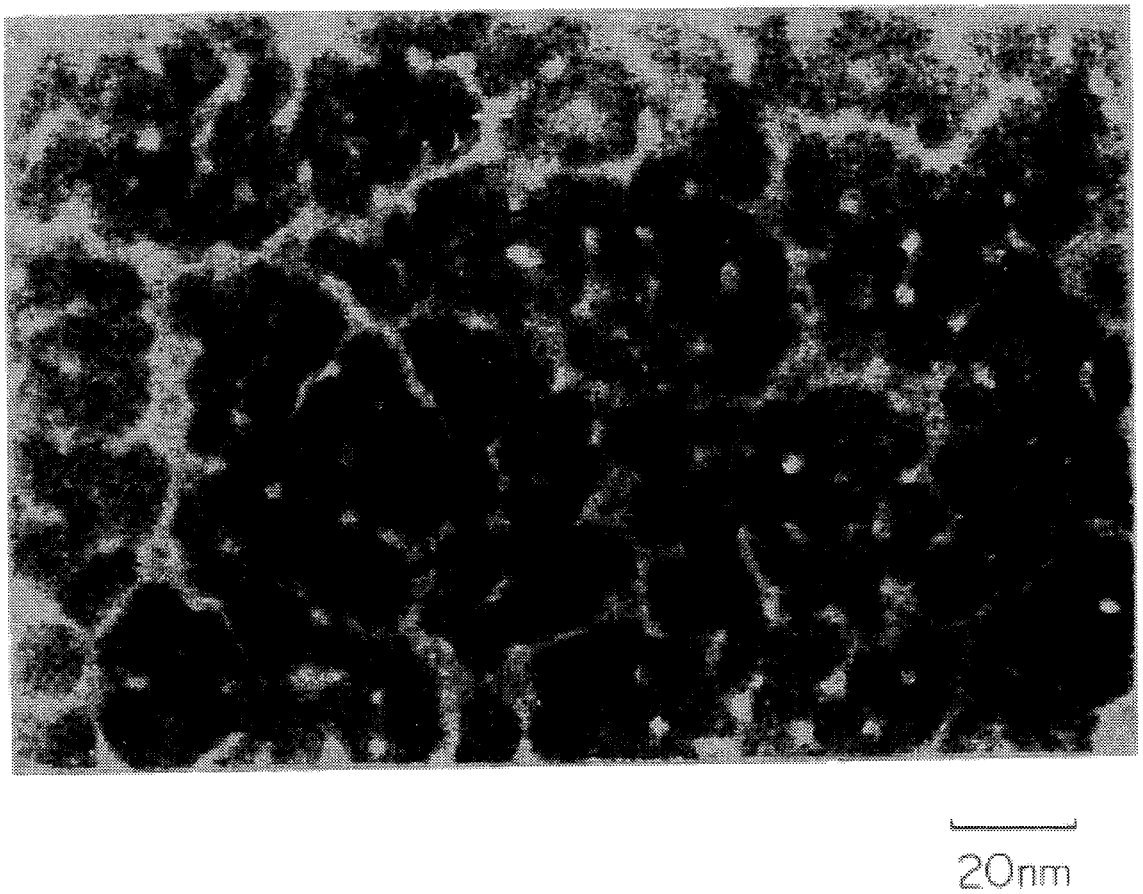

FIG. 11 is a transmission electron micrograph illustrating the microstructure of a double-phase amorphous magnetic thin film obtained in Example 10 of this invention.

Figure 12:
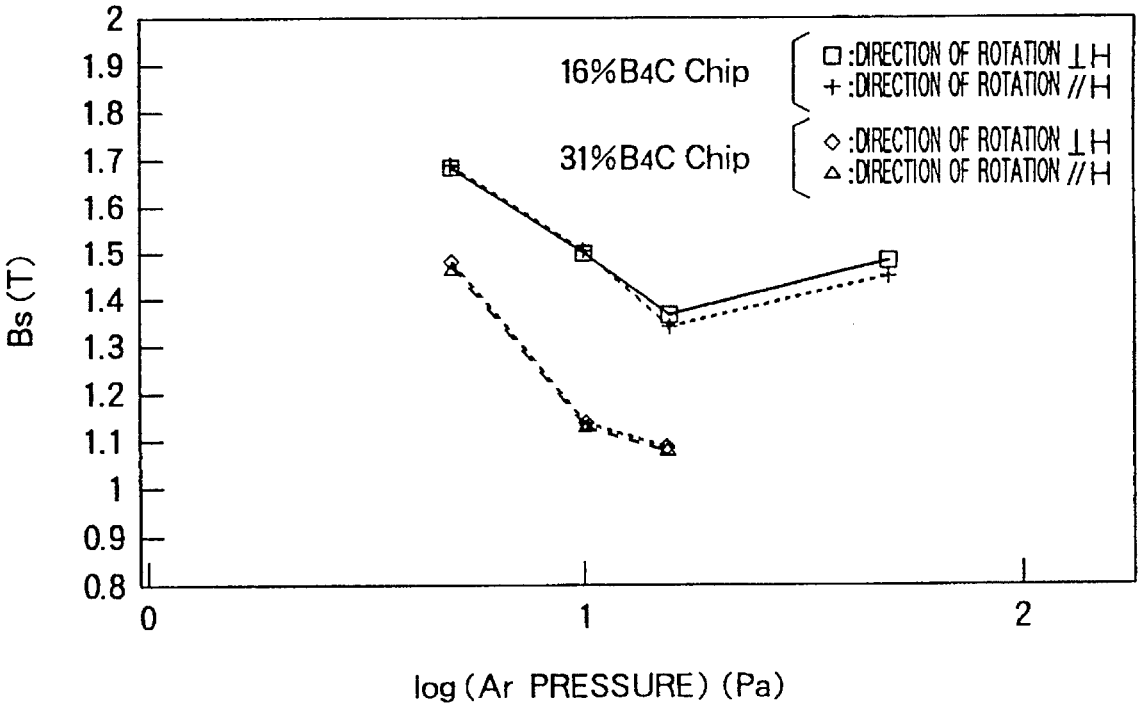

FIG. 12 is a diagram showing one example of the relation between the Ar gas pressure and the saturation flux density during the formation of an Fe-based double-phase amorphous magnetic thin film.

Figure 13:
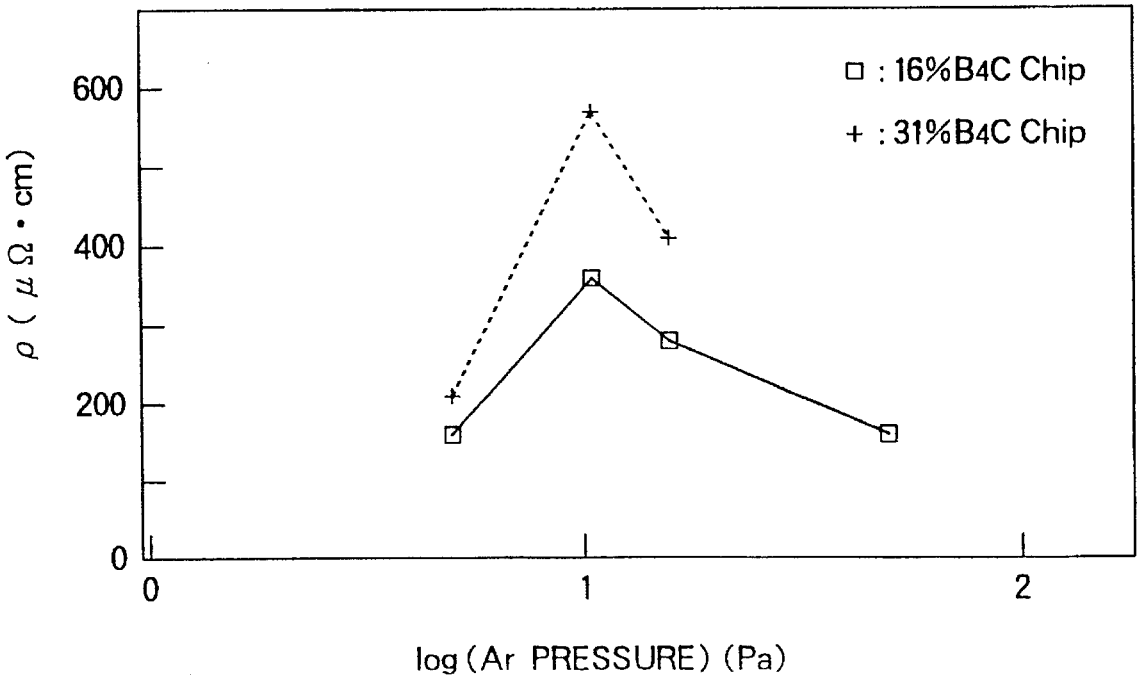

FIG. 13 is a diagram showing one example of the relation between the Ar gas pressure and the resistivity during the formation of the Fe-based double-phase amorphous magnetic thin film.

Figure 14:
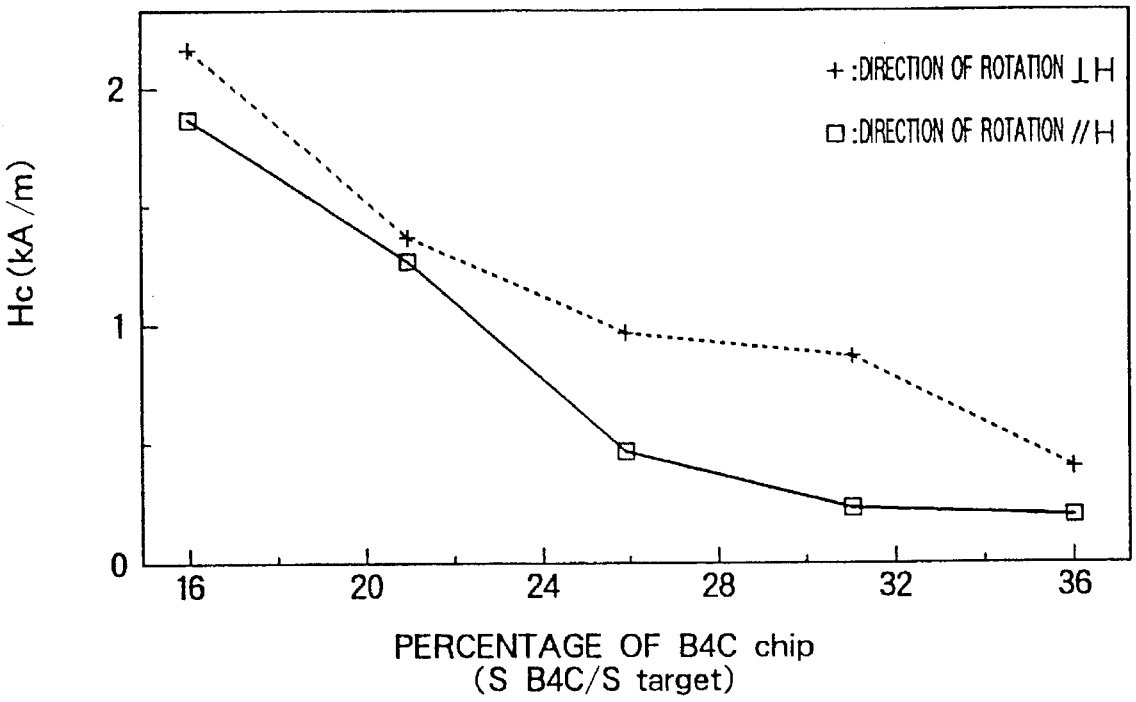

FIG. 14 is a diagram showing one example of the relation between the amount of $B_4C$ chip and the coercive force during the formation of the Fe-based double-phase amorphous magnetic thin film.

Figure 15:
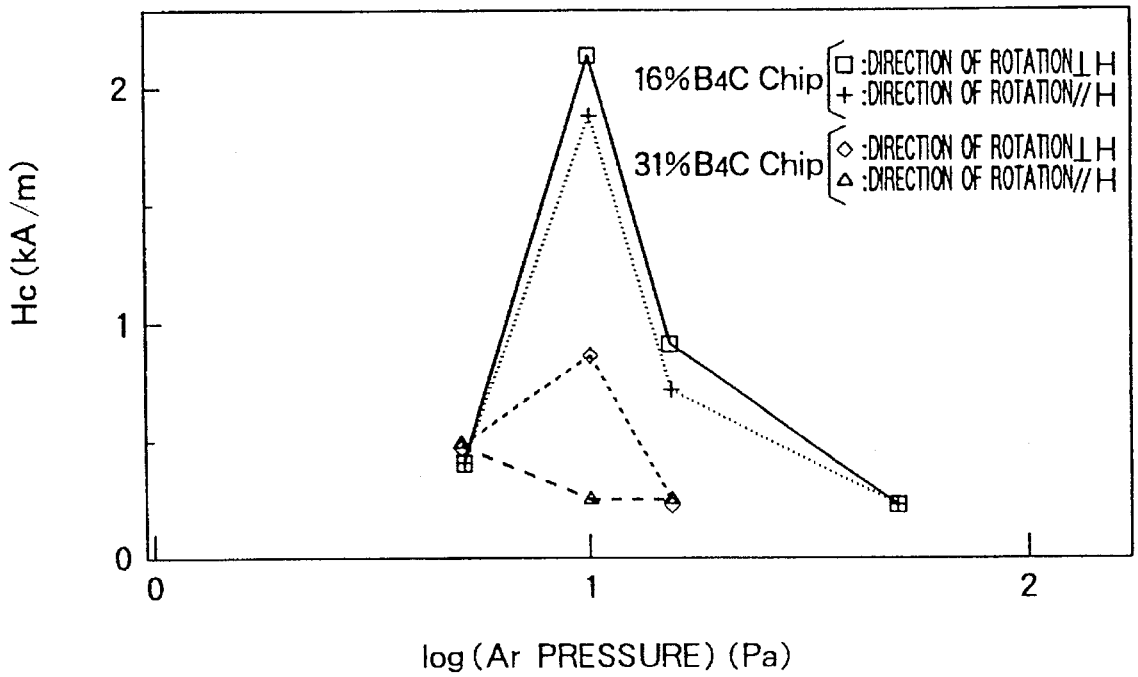

FIG. 15 is a diagram showing one example of the relation between the Ar gas pressure and the coercive force during the formation of the Fe-based double-phase amorphous magnetic thin film.

DESCRIPTION OF THE PREFERRED EMBODIMENTS

Now, this invention will be described more specifically below with reference to working examples thereof.

Figure 1:
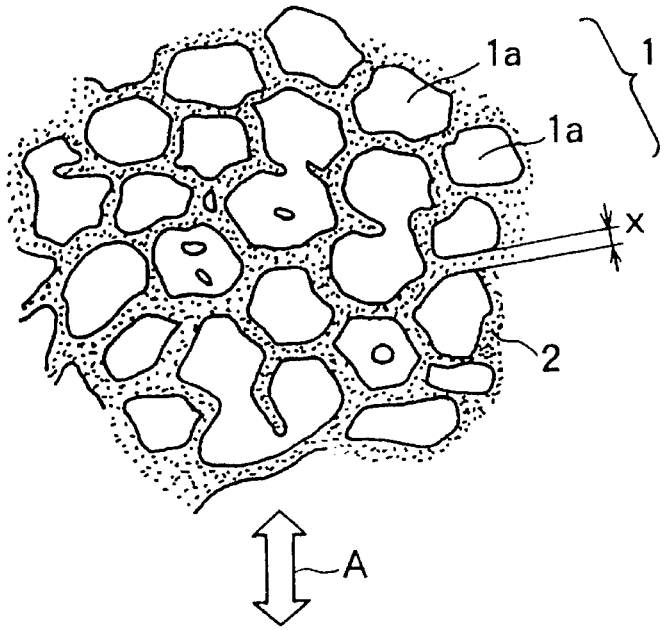
FIG. 1 is a diagram illustrating in the form of a model the microstructure of a double-phase amorphous magnetic thin film obtained in Example 1 of this invention.

FIG. 1 is a diagram illustrating in the form of a model the microstructure of a soft magnetic thin film of this invention for use in plane magnetic elements. The soft magnetic thin film for use in plane magnetic elements, as illustrated in FIG. 1, possesses a microstructure composed of a first amorphous phase 1 bearing magnetism and a second amorphous phase 2 disposed round the first amorphous phase 1 and exhibiting high resistance and, at the same time, manifests uniaxial magnetic anisotropy in the plane of film. In FIG. 1, the arrow mark A macroscopically shows the direction of the easy axis of magnetization with respect to the uniaxial magnetic anisotropy.

The first amorphous phase 1 contains at least either of iron and cobalt. As concrete examples of the construction thereof, an Fe-based magnetic amorphous phase and an Fe—Co-based magnetic amorphous phase may be cited. The second amorphous phase 2 contains boron and at least one element selected from among the elements of the 4B Group in the Periodic Table of Elements. The double-phase amorphous magnetic thin film having Fe or Fe—Co as a main magnetic phase acquires a large saturation magnetization and exhibits a large induced magnetic anisotropy as compared with the conventional Co—Zr—Nb type amorphous thin film, for example.

As regards the film composition of the amorphous magnetic thin film, when the first amorphous phase 1 is based on Fe, the compositional proportion of boron is desired to be in the range of 5 to 40 at % and that of the 4B group element in the range of 3 to 10 at %. If the compositional proportion of boron is less than 5 at % or that of the 4B group element is less than 3 at %, the produced thin film fails to acquire high resistance. If the compositional proportions of boron and the 4B group element respectively exceed 40 at % and 10 at %, the produced thin film fails to acquire high saturation magnetization among other 4B group elements, carbon or a similar is used particularly desirably in respect that the content thereof in the first amorphous phase is suitably repressed. When the compositional proportions are in the ranges mentioned above, the high resistance is obtained without any appreciable sacrifice of the saturation flux density of Fe in the amorphous state. Besides, the uniaxial magnetic anisotropy is easily obtained when the compositional proportions are in these ranges. The particularly desirable compositional proportion of boron is in the range of 10 to 30 at %. When the first amorphous phase 1 is based on Fe—Co, the amorphous magnetic thin film possesses a composition which is substantially represented by the formula (1) mentioned above. The Fe—Co-based amorphous magnetic thin film will be more specifically described hereinbelow.

The amorphous thin film in its entirety exhibits high resistance because the first amorphous phase 1 which mainly contains such a ferromagnetic substance as Fe or Fe—Co is enveloped by the second amorphous phase 2 which mainly contains boron (—4B group element) exhibiting high resistance. It also acquires high saturation magnetization including soft magnetism because the separated fractions 1*a* [resembling islands in a sea] (amorphous grains) of the first amorphous phase 1 possess high saturation magnetization and the parts intervening between the separated fractions 1*a* are magnetically correlated.

For the purpose of magnetically correlating the parts which intervene between the amorphous grains 1*a* of the first amorphous phase 1, the average thickness (width x) of the second amorphous phase 2 which separates the individual amorphous grains 1*a* is desired to be limited to less than about 3 nm. This limitation permits acquisition of particularly desirable soft magnetism. This fact may be logically explained by a supposition that the second amorphous phase 2 has small thickness enough for securing a suitable magnetic interaction between the adjacent amorphous grains 1*a* of the first amorphous phase 1. This effect of the limitation dwindles when the average thickness exceeds 3 nm. The thickness of the second amorphous phase 2 is desired to be not more than 5 nm at most. If the thickness exceeds this upper limit, the soft magnetism is no longer obtained because the size of magnetically correlated region is decreased and the coercive force is increased. The average thickness of the second amorphous phase 2 is not uniquely determined by the yields of the component amorphous phases as aptly evinced by the fact that the ratio of areas of component regions of a given stereoscopic image observed under a microscope is not varied when the image is magnified or contracted. The average thickness, therefore, requires the regions or grains of the second amorphous phase 2 to be copiously decreased.

No lower limit is particularly imposed on the average thickness of the second amorphous phase 2. Since the formation of the second amorphous phase 2 in an average thickness of less than 1 nm is difficult with all the techniques available at present, the lower limit of the average thickness is desired to be set at 1 nm from the practical point of view. If the amorphous grains 1*a* of the first amorphous phase 1 have an unduly large diameter, the local magnetic anisotropy will increase possibly to the extent of degrading the soft magnetism. Thus, the average diameter of the amorphous grains 1*a* is desired to be not more than 15 nm.

The microstructure which has the second amorphous phase exhibiting high resistance disposed reticularly round the first amorphous phase bearing magnetism is obtained by controlling the film-forming conditions, controlling the thin film composition, etc. For example, the microstructure described above is obtained by simultaneously sputtering Fe and a boron (—4B group element) type compound (such as, for example, $B_4C$) which is an insulating substance. It should be noted, however, that the film-forming method is not limited to the sputtering method. The double amorphous phases described above are required to be incorporated as at least part of the thin film forming region. Preferably, however, they form substantially the whole of the thin film.

The amorphous soft magnetic thin film of this invention for use in plane magnetic elements is possessed of uniaxial magnetic anisotropy in the plane of film. The expression "possession of uniaxial magnetic anisotropy" as used herein refers to a case in which the anisotropic magnetic field $H_k$ is not less than 150 A/m. Preferably, the magnitude of the anisotropic magnetic field $H_k$ is not less than 400 A/m. When the first amorphous phase is based on Fe, the inplane uniaxial magnetic anisotropy can be imparted and controlled by controlling the film composition and controlling the film-forming conditions. For example, the inplane uniaxial magnetic anisotropy can be imparted and controlled by adjusting the Ar gas pressure in the approximate range of 0.1 to 1.5 Pa during the formation of the film by sputtering. If the Ar gas pressure during the formation of the film by sputtering exceeds 1.5 Pa, the film-forming rate will be unduly lowered to the extent of impairing the practicality of the produced film. When the first amorphous phase is based on Fe—Co, the inplane uniaxial magnetic anisotropy can be imparted and controlled by controlling the composition, controlling the film-forming conditions, utilizing a larger magnetostriction constant than that of the Fe-based amorphous phase, etc. as will be fully described hereinbelow.

The amorphous magnetic thin film described above and intended for use in plane magnetic elements is possessed of inplane uniaxial magnetic anisotropy besides such soft magnetic properties as high saturation magnetization and high resistivity. The applying magnetic field in the direction of the hard axis of magnetization can be facilitated by imparting the inplane uniaxial magnetic anisotropy and, at the same time, suitably controlling the magnitude of this anisotropy. As a result, the high frequency permeability which is optimized for the properties of a given plane magnetic element can be acquired.

Now, the amorphous magnetic thin film which uses Fe—Co as a main magnetic phase will be described in detail below.

This amorphous magnetic thin film has a composition which is substantially represented by the chemical formula (1):

$$(Fe_{1-x}Co_x)_{1-y}(B_{1-z}X_z)_y \quad (1)$$

(wherein X stands for at least one element selected from among such 4B Group elements as C, Si, and Ge and x, y, and z stand for numerals satisfying the expressions, $0<x\leqq 0.5$, $0.06<y<0.5$, and $0<z<1$) and possesses a microstructure having a second amorphous phase mainly of boron (—4B group element) with high resistance disposed reticularly round a first amorphous phase mainly using Fe—Co and bearing magnetism. The impartation of high resistivity to the magnetic thin film and the repression of the decrease of saturation magnetization from the transition metal mother alloy can be accomplished and the impartation and control of the inplane uniaxial magnetic anisotropy befitting the applying magnetic field along the hard axis of magnetization in the high frequency range can be facilitated by realizing the microstructure described above.

The first amorphous phase containing Fe—Co type transition metals as main components thereof functions effectively in the acquisition of high saturation magnetization. The Fe—Co type alloys are the materials that exhibit the highest levels of saturation magnetization in all the crystalline transition metal alloys. In the amorphous state, these materials suffer their band structures to vary depending on species of metalloid elements, amounts of their addition, etc. and, therefore, cannot generally be regarded as exhibiting the highest levels of saturation magnetization but may be counted among the materials which exhibit high levels of saturation magnetization.

Further, Fe-rich Fe—Co type materials have larger magnetostriction constants than such materials as Fe. This fact can be effectively utilized in inducing magnetic anisotropy associated with magnetoelastic energy through the medium of magnetostriction. Specifically, this induction of the anisotropy is attained by carrying out one treatment or a combination of two or more treatments to be selected from among the treatments of forming the film in a magnetic field, forming the film at an elevated temperature in a magnetic field, forming the film on a substrate exhibiting uniaxial anisotropy with respect to elasticity and thermal expansion coefficient, heat-treating the film in a magnetic field, forming the film on a substrate having strain introduced in advance therein, and introducing strain into the substrate or the magnetic film of the formed film. From this point of view, the value of x (compositional ratio of Fe—Co) in the formula (1) is set so as to satisfy the expression $0<x\leqq 0.5$. Further, in consideration of the magnetic moment per transition metal element and the magnetostriction constant, the value of x is desired to be in the range of $0.1\leqq x\leqq 0.3$. The use of the two transition metal elements of Fe and Co instead of a sole transition metal element can be expected to permit induction of magnetic anisotropy conforming to the directional ordering. To be specific, this induction can be attained by a heat treatment in a magnetic field or by effecting the film formation in a magnetic field, for example.

Besides, the Fe—Co type alloys exhibit the highest Curie temperatures in all the transition metal type amorphous substances. Their Curie temperatures are easily controlled by adjusting the compositional ratio of Fe and Co. By setting the Curie temperature of a given amorphous magnetic thin film at a level higher than the crystallization temperature, for example, the amorphous magnetic thin film can be heat treated while keeping the magnetism thereof intact. As a result, the uniaxial magnetic anisotropy can be easily induced. The crystallization temperature of the amorphous magnetic thin film whose first amorphous phase is based on Fe—Co is roughly below 700K, through somehow variable as with the film composition. Thus, the Curie temperature of this amorphous magnetic thin film is desired to be set at 700K or over.

A thin film magnetic inductance element, for example, generally handles electric power at a high density per unit volume and can be expected to permit a temperature increase to some extent even when the magnetic thin film used therein has enjoyed ample repression of loss. Generally, since various magnetic properties represented by magnetization have dependency on temperature, the properties of the element may possibly be varied by the condition of operation of the element. The increase of the Curie temperature generally proves advantageous for the repression of the temperature dependency. The fact that the Curie temperature can be adjusted as occasion demands is advantageous for the practical use of the element.

In the double-phase amorphous magnetic thin film whose main magnetic phase is based on Fe—Co, the metalloid elements required for impartation of amorphousness to the transition metal rich phase formed mainly of Fe—Co are selected from among 4B group elements represented by boron and carbon. Owing to these elements, the second amorphous phase containing both boron and 4B group elements is formed. This second amorphous phase possesses a strong ability to form a covalent bond and manifests high resistivity. To obtain the second amorphous phase of this quality, the simultaneous inclusion of boron and 4B group elements [thereby confining the value of z in the formula (1) within the range of $0<z<1$] constitutes itself an essential requirement. In the system which has a main magnetic phase of Fe—Co, if the metalloid element content is not sufficient, this system will possibly form a body-centered mixed film of a transition metal crystalline phase and an amorphous phase and will fail to acquire soft magnetism amply. This mishap is avoided effectively by setting the compositional proportion y of the metalloid element (non-transition metal element) at a level exceeding 0.06. The upper limit of the value of y is set at 0.5 from the standpoint of enabling the system to retain high saturation magnetization.

Incidentally, the compositional proportion y of the metalloid element (non-transition metal element) mentioned above appreciably affects the impartation and control of the inplane uniaxial magnetic anisotropy. The inplane uniaxial magnetic anisotropy is not amply obtained unless the value of this compositional proportion y is optimized. FIG. 8 shows one example (test example) of the relation between the compositional proportion y in the formula (1) and the magnetic anisotropy energy $\epsilon_a$ per atom of transition metal. The details of the test will be furnished in Example 8. In the double-phase amorphous thin film of Fe—Co—B (—4B group element), the intrinsic induced magnetic anisotropy is determined by the compositional proportion y, though the characteristic length of dispersion of the first amorphous phase formed mainly of Fe—Co, the volumetric ratio of the component phases, etc. are intricately varied as by various film-forming conditions. FIG. 8 clearly indicates this fact. This is the unique outcome of the inventors' research and development. The macroscopic magnetic anisotropy of a magnetic film is obtained as the product of the number density of transition metal atom per unit space multiplied by the energy $\epsilon_a$ mentioned above. In order that a soft magnetic film to be used in a high frequency range may acquire uniaxial magnetic anisotropy sufficient for practical purpose, therefore, the value of y is desired to be in the range of $0.10<y<0.33$ in which the energy $\epsilon_a$ assumes a sufficient magnitude. Particularly, the compositional proportion y in the range of 0.18 to 0.20 proves advantageous because the energy $\epsilon_a$ assumes a large magnitude in this range.

The 4B group element is used in conjunction with boron to form the second amorphous phase. The value of z [the compositional ratio of boron and (4B group element)] in the formula (1) is only required to be in the range of $0<z<1$. In consideration of the stabilization of the second amorphous phase, the effectiveness of the 4B group element in the control of magnetic properties, etc., however, it is more desirable to confine the value of z within the range of $0.05z<0.5$. Though the 4B group element to be used is not particularly limited, it is desirable to use C or a similar in respect that the 4B group element content in the first amorphous phase can be repressed to a certain extent.

The microstructure which is composed of the first amorphous phase and the second amorphous phase as described above can be obtained by controlling the film-forming conditions, etc. For example, a film structure having the first amorphous phase and the second amorphous phase finely dispersed therein is obtained by simultaneously sputtering Fe—Co and a boron (—4B group element) compound. A similar film structure is obtained by solely sputtering a target which is produced by mixing Fe, Co, B, and a 4B group element and sintering the resultant mixture. Generally, such sputtering methods as RF sputtering method, DC sputtering method, and ion beam sputtering method are suitable techniques available for the formation of the film in question. Besides, the vapour deposition method and other physical film forming methods, the roll method, and the chemical film forming methods are available.

Incidentally, as clearly demonstrated by the Hofmann theory, microcrystallization, repression of the amount of dispersion of local magnetic anisotropy, suitable macroscopic uniaxial magnetic anisotropy, suitable exchange stiffness constant between magnetic particles, etc. function effectively in the acquisition of soft magnetism. Particularly in the amorphous magnetic thin film those main magnetic phase is based on Fe—Co, the local magnetic anisotropy within the first amorphous particles is made as by the magnetostrictive effect to grow larger than in the ordinary Fe-based microcrystalline materials. Thus, the characteristic length of dispersion of the first amorphous grains which corresponds to the ordinary particle diameter and the thickness (width) of the second amorphous phase which separates the first amorphous grains constitute themselves important factors.

As already pointed out, highly desirable soft magnetism is obtained by confining the average thickness (width) of the second amorphous phase separating the first amorphous grains within about 3 nm. The adjustment of this average thickness allows both soft magnetism and inplane uniaxial magnetic anisotropy to be concurrently imparted and controlled. The composition according to the formula (1) (particularly in the range of $0.10<y<0.33$) fits realization of the compatibility of these two properties. The demand on the thickness of the second amorphous phase is more exacting than in the Fe-based double-phase amorphous film. Even in the range in which isotropic soft magnetism is acquired by an Fe-based system, the coercive force possibly reaches a level above 8,000 A/m and the acquisition of soft magnetism becomes impossible in the case of an Fe—Co-based system. The primary cause for this decided contrast is believed to reside in the fact that the local magnetic anisotropy is greater in the Fe—Co-based system than in the Fe-based system.

The amorphous magnetic thin film whose main magnetic phase is based on Fe—Co can be easily vested with inplane uniaxial magnetic anisotropy of a suitable magnitude. The impartation and control of the inplane uniaxial magnetic anisotropy can be attained by various methods as described above and are not limited to any particular method. The impartation and control of the magnetic anisotropy can be accomplished by one method or a combination of two or more methods to be selected from among various methods such as, for example, heat-treating the formed film in a magnetic field, forming the film in a magnetic field, forming the film at an elevated temperature in the neighborhood of 573K in a magnetic field, forming the film at room temperature on a substrate having anisotropy in thermal expansion coefficient, forming the film at high temperatures, forming the film at low temperatures, and introducing strain into the substrate or the magnetic film of the formed film. In these methods, the heat treatment performed on the film in a magnetic field may be cited as a method which particularly fits the control of the uniaxial magnetic anisotropy without sacrifice of soft magnetism. The temperature suitable for this heat treatment is in the range of 530 to 620K, though variable with the film composition. As a result of the heat treatment thus carried out in a magnetic field, the structural anisotropy of the TM—MD pairs between the transition metal (TM) and the metalloid atom (MD) forms the main cause for the induction of magnetic anisotropy.

In the amorphous magnetic thin film, the structure in which the first amorphous phase based mainly on Fe—Co and the second amorphous phase based mainly on boron (—4B group element) fits the acquisition of soft magnetism concurrently enjoying high resistivity and high saturation magnetization and the control of inplane uniaxial magnetic anisotropy for application to the high frequency applying magnetic field along the hard axis of magnetization. This structure permits production of a soft magnetic film which is adapted to confer high operating frequency, high operational efficiency, high energy density, high inductance density, etc. on plane magnetic elements.

The plane magnetic elements contemplated by this invention are constructed by having such Fe-based or Fe—Co-based double phase amorphous magnetic thin films superposed one each on either or both of the opposite surfaces of a plane coil. The plane magnetic elements of this construction are capable of exalting operating frequency and are suitable for miniaturization of plane inductance elements, plane transformers, etc. The amorphous magnetic thin films whose main magnetic phase is based on Fe—Co are applicable not only to plane magnetic elements but also to various thin film magnetic elements.

Now, concrete examples of the amorphous magnetic thin film and the plane magnetic element according to this invention and the results of the rating thereof will be described below.

EXAMPLE 1

An Fe—Co—B—C type thin film was manufactured by the RF magnetron sputtering method. The distance between a substrate and a target was 170 mm. An $Fe_{75}Co_{25}$ alloy target (127 mm in diameter and 1 mm in wall thickness) was used as the target for sputtering. $B_4C$ chips were distributed on the target for addition of B and C. The details of film-forming conditions are shown in Table 1. The area ratio $S_c$ was a film-forming parameter which was obtained by standardizing a $B_4C$ chip area $S_{B4c}$ with a target erosion part area $S_{erosion}$.

TABLE 1

Conditions for formation of Fe—Co—B—C type thin film

| | |
|---|---|
| Sputtering gas | Ar |
| Ar gas pressure during film formation [Pa] | 0.53 |
| $S_c$ (= $S_{B4C}/S_{erosion}$) | 0.39 |
| Sputtering power [W] | 400 |
| Substrate | Thermally oxidized $SiO_2$/Si (100) |
| Substrate temperature | Room temperature (not limited) |

A sample having a film thickness of 0.27 μm was obtained by continuing the film formation under the conditions mentioned above for 5,000 seconds. As a pretreatment immediately preceding the film formation, the target vacuumized to a prescribed degree was presputtered (sputtering power: 400 W) for 600 seconds. The structure and properties of the thin film thus obtained were determined and rated by the procedures described below.

The crystalline structure (microstructure) of the thin film was identified by X-ray diffraction (thin film method: Cu-Kα ray, angle of X-ray incidence α=2.0°) and observation under a transmission electron microscope. The compositional ratio of the thin film was identified by the Inductively Coupled Plasma (ICP) atomic emission spectroscopy and the high frequency heating-infrared absorption method. The thickness of the film was measured by use of a mechanica film thickness meter and the resistivity thereof by use of a four-terminal method (typical sample shape: 15 mm×2 mm). The magnetism was measured by use of a vibrating sample magnetometer. The typical sample shape was 10 mm×10 mm. The maximum magnetic field applied was 0.8 MA/m. The magnetization curves were determined in the direction of the easy axis of magnetization and the direction of the hard axis of magnetization. The magnetic torque curve in the plane of film was determined by use of a thin film torque magnetometer with the external magnetic field rotated within the plane of film. The externally applied magnetic field was 0.8 MA/m. The magnetic torque curve was analyzed by Fourier transform to determine the inplane uniaxial magnetic anisotropic energy.

Figure 2:
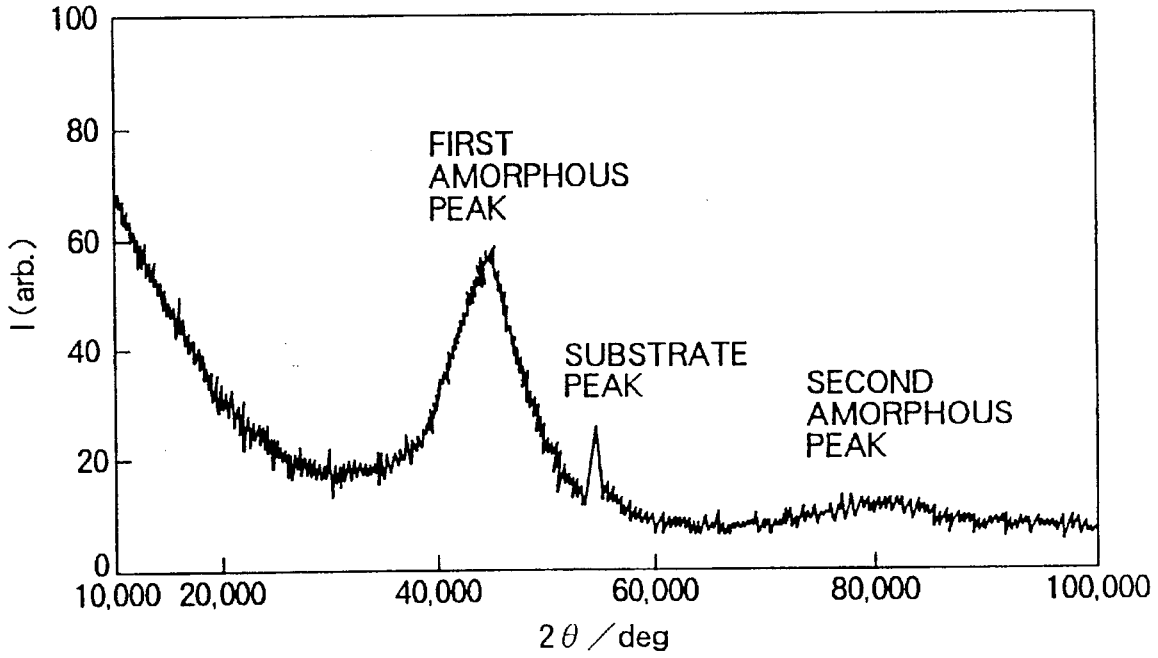
FIG. 2 is a diagram showing the X-ray diffraction pattern of the double-phase amorphous magnetic thin film obtained in Example 1 of this invention.

The X-ray diffraction peak of the thin film obtained in Example 1 described above is shown in FIG. 2. Thus, an amorphous diffraction peak was obtained. FIG. 1 is a diagram illustrating in the form of a model the results of observation of the thin film of Example 1 under a transmission electron microscope (photomicrograph). As noted clearly from FIG. 1 and FIG. 2, it was confirmed that the thin film possessed a microstructure in which a second amorphous phase 2 containing both B and C was reticularly disposed round first amorphous grains 1*a* containing both Fe and Co. The arrow mark A in FIG. 1 indicates the direction of macroscopic uniaxial magnetic anisotropy along the easy axis of magnetization. In all the following examples, the occurrence of similar double-phase amorphous phases were confirmed. The position of the amorphous peak showed virtually no change, while the half value width thereof was notably varied by the film-forming conditions.

The magnetization curve of the thin film obtained in the present example is shown in each of FIGS. 3A and 3B. Thus, a clear sign of inplane uniaxial magnetic anisotropy was observed in the thin film. The saturation magnetization was 1.2 T and the resistivity was 280 μΩcm. The inplane uniaxial magnetic anisotropic energy was $4\times10^2$ J/m$^3$. The compositional ratio of the thin film was found to be x=0.26, y=0.3, and z=0.2. The average thickness of the second amorphous phase 2 separating the first amorphous phase 1 was about 2.5 nm.

The combined effects of the film-forming conditions and the composition of component elements permitted production of an amorphous magnetic thin film concurrently enjoying high resistivity and high saturation magnetization and, at the same time, possessing inplane uniaxial magnetic anisotropy.

EXAMPLE 2

The thin film obtained in Example 1 described above was heat-treated in an inplane DC magnetic field. The temperature of the heat treatment was 535K and the duration thereof was 10,800 seconds. The magnitude of the applied magnetic field was 0.8 MA/m and the direction thereof was parallel to the direction of the easy axis of magnetization. As a result, the coercive force of the thin film decreased to below 80 A/m while the inplane uniaxial magnetic anisotropy varied only slightly.

The so-called strain relief heat treatment performed as described above permitted the amorphous magnetic thin film to acquire such soft magnetic properties as high resistivity and high saturation magnetization without any appreciable sacrifice of the magnetic anisotropy.

EXAMPLE 3

An Fe—Co—B—C type thin film was formed by using the same film forming conditions as in Example 1 while changing the chip area ratio $S_c$ (=$S_{B4C}/S_{erosion}$) to 0.24. A sample having a film thickness of 0.22 μm was obtained by carrying out the film formation under these conditions for a duration of 3,000 seconds. This thin film possessed inplane uniaxial magnetic anisotropy. The saturation magnetization was 1.7 T and the resistivity was 220 μΩcm. The compositional ratio of the thin film was found to be x=0.25, y=0.2, and z=0.31. The average thickness of the second amorphous phase separating the first amorphous phase was about 3.5 nm.

EXAMPLE 4

An Fe—Co—B—C type thin film was formed under the same conditions as in Example 1 while changing the chip area ratio $S_c$ (=$S_{B4C}/S_{erosion}$) to 0.31 and the Ar gas pressure during the film formation to 0.27 Pa. A sample having a film thickness of 0.24 μm was obtained by carrying out the film formation under these conditions for 4,000 seconds. The saturation magnetization of this thin film was 1.6 T and the resistivity thereof was 160 μΩcm. At the stage following the completion of the formation of this thin film, the thin film acquired inplane uniaxial magnetic anisotropy and exhibited a low coercive force of 39.6 A/m in the applying magnetic field along the hard axis of magnetization. The compositional ratio of the thin film was found to be x=0.26, y=0.25, and z=0.28. The average thickness of the second amorphous phase separating the first amorphous phase was less than 2.0 nm.

EXAMPLE 5

A film was formed in a DC magnetic field. The magnetic field was applied in a direction in which an hard axis of magnetization would be obtained in the formation of a film in the absence of exertion of a magnetic field in the stage following the completion of the formation of the film. The DC magnetic field so applied was 55 kA/m. The other film-forming conditions were the same as those of Example 4. The magnetization curve of the sample obtained is shown in FIG. 4. As is clearly noted from each of FIGS. 4A and 4B, the thin film induced inplane uniaxial magnetic anisotropy in the direction of the applied magnetic field. The inplane uniaxial magnetic anisotropy energy was $3.5\times10^2$ J/m$^3$. The resistivity and the saturation magnetization acquired by the thin film were identical to those of the thin film of Example 4 within the accuracy of determination. The film formation thus carried out in a magnetic field permitted impartation and control of the inplane uniaxial magnetic anisotropy.

EXAMPLE 6

An Fe—Co—B—C—Si type thin film was formed under the same conditions as in Example 4 while using three more Si chips (10 mm×20 mm) on the target. A sample having a film thickness of 0.25 μm was obtained by carrying out the film formation under these conditions for 4,000 seconds. The saturation magnetization of this thin film was 1.2 T and the resistivity thereof was 210 μΩcm. The magnetization curve of this thin film is shown in each of FIGS. 5A and 5B. The data indicate that the amorphous magnetic thin film produced in the present example combined inplane uniaxial magnetic anisotropy and low coercive force of not more than 80 A/m and concurrently acquired high saturation magnetization and high resistivity.

EXAMPLE 7

A metal mask adapted to give rise to a series of magnetic thin films of the shape of a ribbon 0.9 mm wide spaced at intervals of 0.1 mm was prepared and used in forming such ribbonlike magnetic thin films under the same conditions as in Example 4. These ribbons were parallel to a direction in which inplane easy axes of magnetization were induced in the stage following the completion of the film formation. As a result, the thin films acquired inplane uniaxial magnetic anisotropy of $1.5\times10^{2\ J/m3}$ and produced easy axes of magnetization in a direction parallel to the ribbons. The uniaxial magnetic anisotropy acquired inherently by the double-phase amorphous thin films in themselves was effective in minimizing locallized magnetic anisotropy. Thus, the macroscopic magnetic anisotropy could be controlled by conferring the induction of magnetic anisotropy of shape generally applicable to all the common magnetic articles on the uniaxial magnetic anisotropy generated in the stage following the completion of the film formation. This fact indicates that the method of control applicable to all the common magnetic articles can be supplementarily used for the amorphous magnetic thin films of the present invention.

EXAMPLE 8

Samples prepared under conditions widely varying the Ar gas pressure and the $B_4C$ chip area ratio $S_c$ ($=S_{B4C}/C_{erosion}$) in the course of film formation were heat-treated under a vacuum in a DC magnetic field at a temperature of 573K for 7,320 seconds. The applied magnetic field was 0.8 MA/m and the vacuum degree during the heat treatment was below $1\times10^{-2}$ Pa. The other conditions were the same as those shown in Table 1. The samples resulting from the heat treatment had film thicknesses in the range of 0.2 to 0.3 μm.

Examples of the magnetization curve of the samples are shown in each of FIGS. 6A and 6B. The samples obtained in the present example acquired uniform uniaxial magnetic anisotropy and exhibited ideal magnetization reversal of rotation in magnetic hard axis. FIGS. 7A–7D illustrate anisotropic magnetic fields $H_k$ of samples varying in quality. The magnitudes of magnetic anisotropic energy $\epsilon_a$ generated by these samples per atom of transition metal which were calculated based on the data of FIG. 7 in combination with the various results of analysis such as the compositional ratios were studied to determine their dependency on the compositional ratio of Fe—Co and B—C [the value y in the formula (1)]. The results are shown in FIG. 8. It is remarked from FIG. 8 that, in the group of samples produced under conditions widely varying the Ar gas pressure and the $B_4C$ chip area ratio $S_c$ during the film formation, the compositional ratio y affected the anisotropic energy to a great extent.

COMPARATIVE EXAMPLE 1

A film was formed by adopting the same conditions as those of Example 1 while changing the Ar gas pressure to 1 Pa and the chip area ratio $S_c$ to 0.08 during the film formation. The film formation continued under these conditions for 2,000 seconds produced a sample having a film thickness of 0.22 μm. When this thin film was subjected to X-ray diffraction, it was identified to be a mixed phase consisting of an α-Fe type body-centered crystalline substance and an amorphous substance. This sample acquired saturation magnetization of 1.4 T and resistivity of 350 μΩcm. Owing to the mixed phase with a crystalline substance, the sample showed coercive force of 9.98 kA/m and failed to acquire soft magnetism.

COMPARATIVE EXAMPLE 2

A film was formed by using the same conditions as those of Comparative Experiment 1 while changing the chip area ratio $S_c$ to 0.24. The film formation continued under these conditions for 3,000 seconds produced a sample having a film thickness of 0.23 μm. When this thin film was subjected to X-ray diffraction and observation under a transmission electron microscope, it was found to be a double-phase amorphous film similar to the sample of Example 1. The average thickness of the second amorphous phase separating the Fe—Co-based first amorphous grains was about 5.0 nm. This sample acquired saturation magnetization of 1.2 T and resistivity of 590 μΩcm. It was an isotropic film as shown in each of FIGS. 9A and 9B and generated coercive force exceeding 3.2 kA/m in any given direction and acquired neither inplane uniaxial magnetic anisotropy nor soft magnetism.

COMPARATIVE EXAMPLE 3

A film was formed by adopting the same conditions as those of Comparative Experiment 1 while changing the Ar pressure to 0.4 Pa and the chip area ratio $S_c$ to 0.16 during the film formation. The thin film thus obtained was not a double-phase amorphous film but a mixed phase consisting of a crystalline substance and an amorphous substance. The compositional ratio of the thin film was found to be x=0.25, y=0.05, and z=0.3. The results indicate that no double-phase amorphous film is obtained when the value of y is unduly small.

EXAMPLE 9

A magnetic film portion (double-phase amorphous magnetic thin film) 12 of a thin film inductor 11 illustrated in FIG. 10 was manufactured under the same conditions as those of Example 5. It was then heat-treated in a magnetic field under the same conditions as those of Example 2. The thin film inductor 11 shown in FIG. 10 was constructed by superposing double-phase amorphous magnetic thin films 12, 12 one each on the opposite main surfaces of a double rectangular plane coil 13. In FIG. 10, 14 stands for an electrode and the arrow mark B indicates the easy axis of magnetization and the arrow mark C indicates the magnetic flux. The thin film inductor obtained in this example showed a substantially flat inductance up to 50 MHz and acquired ideal properties as evinced by a quality coefficient Q exceeding 10.

EXAMPLE 10

An Fe—B—C type thin film was manufactured by use of an RF magnetron sputtering apparatus. An Fe target with an assay of 99.9% and a diameter of 127 mm was used as the target for sputtering. $B_4C$ chips were distributed on the Fe target mentioned above for addition of B and C. The surface ratio $S_c$ was set at 31%. The details of the film-forming conditions are shown in Table 2.

TABLE 2

| Conditions for forming Fe—B—C type thin film | |
|---|---|
| Preliminary evacuation [Pa] | $4.0 \times 10^{-4}$ |
| Sputtering gas | Ar |
| Ar gas pressure during film formation [Pa] | 1.1 |
| Sputtering power [W] | 400 |
| Substrate temperature | Room temperature (not limited) |
| Substrate | Thermally oxidized $SiO_2$/Si (100) |

A sample having a film thickness of 0.2 μm was obtained under the conditions mentioned above. When the microstructure of this thin film was observed under a transmission electron microscope, as shown in FIG. 11, it was found to comprise an Fe rich first amorphous phase and a B—C rich second amorphous phase, with the second amorphous phase dispersed reticularly round the first amorphous phase. The saturation magnetization of this thin film was 1.2 T and the resistivity thereof was 500 μΩcm. It was confirmed that this thin film was possessed of inplane uniaxial magnetic anisotropy in the stage following the completion of the film formation.

Similar amorphous thin films were formed by adopting the same conditions as those of Example 10 while widely varying the Ar gas pressure during the film formation. These thin films were tested for saturation magnetization density and resistivity. The results are shown in FIG. 12 and FIG. 13. FIG. 14 shows the relation between the amount of $B_4C$ chips and the coercive force. It is clearly noted from these diagrams that soft magnetism concurrently enjoying saturation magnetization and resistivity was obtained by controlling the Ar gas pressure during the film formation. The relation between the Ar gas pressure during the film formation and the coercive force is shown in FIG. 15. It is remarked from this diagram that the thin films were enabled to acquire uniaxial magnetic anisotropy by controlling the Ar gas pressure during the film formation.

When thin film inductors were manufactured in the same manner as in Example 9 using the amorphous thin films produced in the present example, they likewise exhibited ideal properties.

As demonstrated in the working examples cited above, the amorphous magnetic thin films of this invention for use in plane magnetic elements concurrently enjoy high saturation magnetization and high resistivity and easily acquire high frequency permeability by applying magnetic field in the axes of difficult magnetization. The plane magnetic elements using these amorphous thin films permit miniaturization of devices and impartation of high performance to the devices.

What is claimed is:

1. An amorphous magnetic thin film containing iron, cobalt, boron and at least one element selected from the group consisting of the Group 4B elements in the CAS version of the Periodic Table, and possessing as at least part of a thin film forming area a microstructure composed of a first amorphous phase containing iron and cobalt and bearing magnetism and a second amorphous phase disposed around said first amorphous phase and containing boron and at least one element selected from the group consisting of the Group 4B elements, wherein said amorphous magnetic thin film exhibits uniaxial magnetic anisotropy in the plane of film, and said iron is of a greater amount than said cobalt.

2. An amorphous magnetic thin film according to claim 1, wherein said amorphous magnetic thin film is for use in plane magnetic elements.

3. An amorphous magnetic thin film according to claim 1, wherein said first amorphous phase mainly contains iron.

4. An amorphous magnetic thin film according to claim 3, which is composed of 5 to 40 at % of boron, 3 to 10 at % of a 4B group element, and the balance substantially of iron.

5. An amorphous magnetic thin film according to claim 1, wherein said 4B group elements include carbon.

6. An amorphous magnetic thin film according to claim 1, wherein the average thickness of said second amorphous phase separating said first amorphous phase is not more than 3 nm.

7. An amorphous magnetic thin film according to claim 1, which possesses magnetic anisotropy field $H_k$ of not less than 150 A/m.

8. An amorphous magnetic thin film possessing a composition substantially represented by the chemical formula $$(Fe_{1-x}CO_x)_{1-y}(B_{1-z}X_z)_y$$

wherein X stands for at least one element selected from the group consisting of the Group 4B elements in the CAS version of the Periodic Table and x, y, and z stand for numerals satisfying the expressions, $0.1 \leqq x \leqq 0.5$, $0.06<y<0.5$, and $0<z<1$, said amorphous magnetic thin film possessing as at least part of a thin film forming area a microstructure composed of a first amorphous phase containing both iron and cobalt and bearing magnetism and a second amorphous phase disposed round said first amorphous phase and containing boron and at least one element selected from the group consisting of the Group 4B elements in the CAS version of the Periodic Table, and said second amorphous phase separating said first amorphous phase has an average thickness of not more than 3 nm.

9. An amorphous magnetic thin film according to claim 8, wherein X in said chemical formula includes carbon.

10. An amorphous magnetic thin film according to claim 8, which exhibits uniaxial magnetic anisotropy in the plane of film.

11. An amorphous magnetic thin film according to claim 8, which possesses a higher Curie temperature than the temperature of crystallization thereof.

12. An amorphous magnetic thin film according to claim 8, which possesses a crystallization temperature of less than about 700K and a Curie temperature of not less than about 700K.

13. An amorphous magnetic thin film according to claim 8, which possesses an anisotropic magnetic field $H_k$ of not less than 150 A/m.

14. A plane magnetic element, comprising a plane coil and an amorphous magnetic thin film disposed as superposed on at least one of opposite surfaces of said plane coil, said amorphous magnetic thin film containing iron, cobalt, boron and at least one element selected from the group consisting of the Group 4B elements in the CAS version of the Periodic Table, and possessing as at least part of a thin film forming area a microstructure composed of a first amorphous phase containing iron and cobalt and bearing magnetism and a second amorphous phase disposed round said first amorphous phase and containing boron and at least one element selected from the group consisting of the Group 4B elements, wherein said amorphous magnetic thin film exhibits uniaxial magnetic anisotropy in the plane of film, and said iron is of a greater amount than said cobalt.

15. A plane magnetic element according to claim 14, wherein said amorphous magnetic thin film is composed of 5 to 40 at % of boron, 3 to 10 at % of a 4B group element, and the balance substantially of iron.

16. A plane magnetic element according to claim 14, wherein said amorphous magnetic thin film possesses a composition substantially represented by the formula:

$$(Fe_{1-x}Co_x)_{1-y}(B_{1-z}X_z)_y$$

(wherein X stands for at least one element selected from among the 4B Group elements and x, y, and z stand for numerals satisfying the expressions, $0<x\leqq 0.5$, $0.06<y<0.5$, and $0<z<1$).

17. A plane magnetic element according to claim 14, the average thickness of said second amorphous phase separating said first amorphous phase is not more than 3 nm.

18. A plane magnetic element according to claim 16, wherein said amorphous magnetic thin film possesses a higher Curie temperature than the temperature of crystallization thereof.

19. A plane magnetic element according to claim 14, wherein said amorphous magnetic thin film possesses an anisotropic magnetic field $H_k$ of not less than 150 A/m.

20. A plane magnetic element according to claim 14, which is a plane inductance element or a plane transformer.

21. An amorphous magnetic thin film possessing a composition substantially represented by the chemical formula $$(Fe_{1-x}Co_x)_{1-y}(B_{1-z}X_z)_y$$

wherein X stands for at least one element selected from the group consisting of the Group 4B elements in the CAS version of the Periodic Table and x, y, and z stand for numerals satisfying the expressions, $0.1\leqq x\leqq 0.5$, $0.06<y<0.5$, and $0<z<1$, said amorphous magnetic thin film possessing as at least part of a thin film forming area a microstructure composed of a first amorphous phase containing both iron and cobalt and bearing magnetism and a second amorphous phase disposed round said first amorphous phase and containing boron and at least one element selected from the group consisting of the Group 4B elements in the CAS version of the Periodic Table, and an average thickness of said second amorphous phase separating said first amorphous phase is not more than 3 nm, said amorphous magnetic thin film exhibiting uniaxial magnetic anisotropy in the plane of film, said uniaxial magnetic anisotropy being induced by heat-treating at a temperature of not more than the Curie temperature of the amorphous magnetic thin film in a magnetic field, and said Curie temperature being not less than the crystallization temperature of the amorphous magnetic thin film.

* * * * *

UNITED STATES PATENT AND TRADEMARK OFFICE

CERTIFICATE OF CORRECTION

PATENT NO. : 5,522,946

DATED : June 04, 1996

INVENTOR(S) : Hiroshi TOMITA et al.

It is certified that error appears in the above-indentified patent and that said Letters Patent is hereby corrected as shown below:

In the Abstract, Line 22, "0< X 0.5," should read --0< X $\leq$0.5,--;

Claim 8, Column 16, Line 44, "$(Fe_{1-x}CO_x)_{1-y}(B_{1-z}X_z)_y$" should read --$(Fe_{1-x}Co_x)_{1-y}(B_{1-z}X_z)_y$--.

Signed and Sealed this

Twenty-fourth Day of December, 1996

*Attest:*

Bruce Lehman

BRUCE LEHMAN

*Attesting Officer*

*Commissioner of Patents and Trademarks*